US008169155B2

(12) United States Patent
Hong et al.

(10) Patent No.: US 8,169,155 B2
(45) Date of Patent: May 1, 2012

(54) METHOD OF DRIVING LIGHT SOURCE, LIGHT SOURCE DRIVING APPARATUS FOR PERFORMING THE METHOD, AND DISPLAY APPARATUS HAVING THE LIGHT SOURCE APPARATUS

(75) Inventors: Hyun-Seok Hong, Daejeon (KR); Yo-Han Lee, Asan-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 408 days.

(21) Appl. No.: 12/464,407

(22) Filed: May 12, 2009

(65) Prior Publication Data

US 2010/0141155 A1 Jun. 10, 2010

(30) Foreign Application Priority Data

Dec. 8, 2008 (KR) ..... 10-2008-0123722

(51) Int. Cl.
*G05F 1/00* (2006.01)

(52) U.S. Cl. ..... 315/291; 315/295; 315/297; 315/301; 315/308; 315/311

(58) Field of Classification Search ..... 315/291, 315/294–295, 297, 299, 301, 307–308, 311
See application file for complete search history.

(56) References Cited

U.S. PATENT DOCUMENTS

| | | | | |
|---|---|---|---|---|
| 5,990,634 | A * | 11/1999 | Brown | 315/307 |
| 6,118,221 | A * | 9/2000 | Kumasaka et al. | 315/209 PZ |
| 7,417,616 | B2 * | 8/2008 | Min et al. | 345/102 |
| 7,423,389 | B2 * | 9/2008 | Lee | 315/308 |
| 7,489,090 | B2 * | 2/2009 | Taipale | 315/307 |
| 7,719,208 | B2 * | 5/2010 | Li et al. | 315/307 |
| 2003/0001522 | A1 * | 1/2003 | Newman et al. | 315/291 |
| 2006/0175986 | A1 * | 8/2006 | Lee et al. | 315/312 |
| 2007/0132712 | A1 * | 6/2007 | Song | 345/102 |
| 2008/0180040 | A1 * | 7/2008 | Prendergast et al. | 315/297 |
| 2010/0019697 | A1 * | 1/2010 | Korsunsky et al. | 315/307 |
| 2010/0060671 | A1 * | 3/2010 | Park et al. | 345/690 |

FOREIGN PATENT DOCUMENTS

| | | |
|---|---|---|
| KR | 1020020009292 | 2/2002 |
| KR | 1020050097357 | 10/2005 |
| KR | 1020060089375 | 8/2006 |
| KR | 1020070076078 | 7/2007 |

* cited by examiner

*Primary Examiner* — Jason M Crawford
(74) *Attorney, Agent, or Firm* — F. Chau & Associates, LLC

(57) ABSTRACT

A method of driving a light source includes adjusting a number of duty adjustments of driving signals driving light sources based on a dimming control signal and adjusting each duty ratio of each of the driving signals provided to each of the light sources in accordance with the adjusted number of the duty adjustments.

15 Claims, 7 Drawing Sheets

METHOD OF DRIVING LIGHT SOURCE, LIGHT SOURCE DRIVING APPARATUS FOR PERFORMING THE METHOD, AND DISPLAY APPARATUS HAVING THE LIGHT SOURCE APPARATUS

CROSS REFERENCE TO RELATED APPLICATIONS

This application claims priority under 35 U.S.C. §119 to Korean Patent Application No. 2008-123722, filed on Dec. 8, 2008 in the Korean Intellectual Property Office (KIPO), the disclosure of which is incorporated by reference in its entirety herein.

BACKGROUND OF THE INVENTION

1. Technical Field

Exemplary embodiments of the present invention relate to a method of driving a light source, a light source driving apparatus for performing the method, and a display apparatus having the light source apparatus.

2. Discussion of Related Art

A liquid crystal display (LCD) apparatus includes an LCD panel that is configured to display an image using light, and a backlight assembly disposed below the LCD panel to provide the light to the LCD panel. The LCD panel includes a first substrate having a plurality of thin-film transistors (TFTs) and a plurality of pixel electrodes, a second substrate having a common electrode facing the first substrate, and a liquid crystal layer interposed between the first substrate and the second substrate.

The backlight assembly includes a light source unit that generates and provides the light to the LCD panel. The light source unit may include rod-shaped cold cathode fluorescent lamps (CCFLs), light-emitting diodes (LEDs), etc. The LEDs may be chosen due to their low power consumption and high color reproducibility.

An LED may include a red LED generating red light, a green LED generating green light and a blue LED generating blue light. The red, green and blue light generated from the red, green and blue LEDs may be combined with each other to generate white light. The coordinates of the LEDs emitting white light may be determined in accordance with the amounts of the red, green and blue light emitted from each LED.

A display apparatus can maintain the LEDs generating white light using a feedback of the detected amounts of red, green, and blue light. However, when a dimming level control signal is provided to the LCD apparatus and light having a high rate of color distortion is compensated for, a relatively high color oscillation of the light may be generated.

The duty ratios of the driving signals provided to the red, green and blue LEDs may be adjusted through feedback control. The feedback control is repeatedly performed using a dimming level control signal corresponding to a rapid luminance variation. However, the repeated use of the feedback may slow the response time of the display apparatus.

Thus, there is a need for a method of driving a light of a display apparatus that can reduce color oscillation and improve response time, a light source driving apparatus performing the method, and a display apparatus have the light source driving apparatus.

SUMMARY OF THE INVENTION

An exemplary embodiment of the present invention includes a method of driving a light source. The method includes: adjusting a number of duty adjustments of driving signals driving light sources based on a dimming control signal and adjusting each duty ratio of each of the driving signals provided to each of the light sources in accordance with the adjusted number of the duty adjustments. The light sources may include a red light source, a green light source and a blue light source.

Adjusting the number of duty adjustments of the driving signals may include: comparing a dimming level of the dimming control signal with a reference dimming level, and adjusting a feedback frequency based on a result of the comparing, where the feedback frequency is the number of the duty ratios of the driving signals is repeatedly adjusted per unit time.

The feedback frequency may be reduced when the dimming level of the dimming control signal is lower than the reference dimming level. The feedback frequency may be maintained when the dimming level of the dimming control signal is greater than or equal to the reference dimming level. The method may further include adjusting each duty ratio of the driving signals based on color light (e.g., the coordinates of white light) sensed by a light sensor when the dimming control signal is de-asserted (e.g., not applied).

Adjusting the number of duty adjustments of the driving signals may be performed when reference duty ratios of the driving signals are in a stable range, where the duty rations are provided to the light sources based on the dimming control signal. Further, adjusting each of the duty ratios of each of the driving signals may be performed by storing the reference duty ratios of the driving signals for adjusting the duty ratios of the driving signals provided to the light sources based on whether the driving signals are stable.

When the reference duty ratios are determined to be in the stabile range in adjusting the number of duty adjustments of the driving signals, the duty ratios of the driving signals may be adjusted based on the stored reference duty ratios of the driving signals and the dimming level of the dimming control signal in adjusting each of the duty ratios of each of the driving signals.

An exemplary embodiment of the present invention includes a light source driving apparatus having a compensation control part and a feedback compensation part. The compensation control part is configured to adjust a number of duty adjustments of driving signals driving light sources based on a dimming control signal. The feedback compensation part is configured to adjust each duty ratio of each of the driving signals provided to each of the light sources in accordance with the adjusted number of the duty adjustments adjusted by the compensation control part.

The feedback compensation part may correspond to a plurality of color light emitted from the light sources and reference white color coordinates to adjust the duty ratios of the driving signals, when the adjusted number of the duty adjustments is at least one, and the feedback compensation part may be repeatedly operated by the adjusted number of the duty adjustments. The color light may include red light, green light and blue light.

The compensation control part may include a dimming level comparing part comparing a dimming level of the dimming control signal with a reference dimming level, and a feedback frequency adjusting part providing the feedback compensation part with a signal which controls a feedback frequency based on a result of the comparing, where the feedback frequency is the number of the duty adjustments of the feedback compensation part per unit time.

The feedback frequency adjusting part may be configured to reduce the feedback frequency when the dimming level of the dimming control signal is substantially lower than the reference dimming level. The feedback frequency adjusting part may be configured to maintain the feedback frequency when the dimming level of the dimming control signal is equal to or higher than the reference dimming level.

The feedback compensation part may adjust the duty ratios of the driving signals based on reference duty ratios of the driving signals and a dimming level of the dimming control signal, when the number of the duty adjustments is at least one.

The compensation control part may include a determining part which determines whether or not the reference duty ratios of the driving signals are in a stabile range based on the dimming control signal. The feedback compensation part may include a storage part which stores the reference duty ratios of the driving signals based on whether the determining part determined the ratios to be in the stable range.

An exemplary embodiment of the present invention includes a display apparatus having a display panel, a light source module, a compensation control part and a feedback compensation part. The display panel is configured to display an image. The light source module includes a red light source, a green light source and a blue light source to provide the display panel with light. The compensation control part is configured to adjust a number of duty adjustments of the driving signals driving each light source based on a dimming control signal. The feedback compensation part is configured to adjust duty ratios of the driving signals provided to each of the light sources in accordance with the number of the duty adjustments adjusted by the compensation control part.

The feedback compensation part may operate about 95 times through about 105 times per second, when the dimming control signal is not applied thereto. The feedback compensation part may reduce a feedback frequency when the dimming control signal is applied thereto, where the feedback frequency the number of the duty adjustments of the driving signals performed per unit time. The feedback compensation part may operate one time and adjust the duty ratios of the driving signals based on reference duty ratios of the driving signals and a dimming level of the dimming control signal when the dimming control signal is applied thereto.

BRIEF DESCRIPTION OF THE DRAWINGS

The present invention will become more apparent by describing in detailed exemplary embodiments thereof with reference to the accompanying drawings, in which.

DETAILED DESCRIPTION OF EXEMPLARY EMBODIMENTS

The present invention is described more fully hereinafter with reference to the accompanying drawings, in which exemplary embodiments of the present invention are shown. The present invention may, however, be embodied in many different forms and should not be construed as limited to the exemplary embodiments set forth herein.

It will be understood that when an element or layer is referred to as being "on," "connected to" or "coupled to" another element or layer, it can be directly on, connected or coupled to the other element or layer or intervening elements or layers may be present. Like numerals refer to like elements throughout.

Hereinafter, exemplary embodiments of the present invention will be explained in detail with reference to the accompanying drawings.

Figure 1:
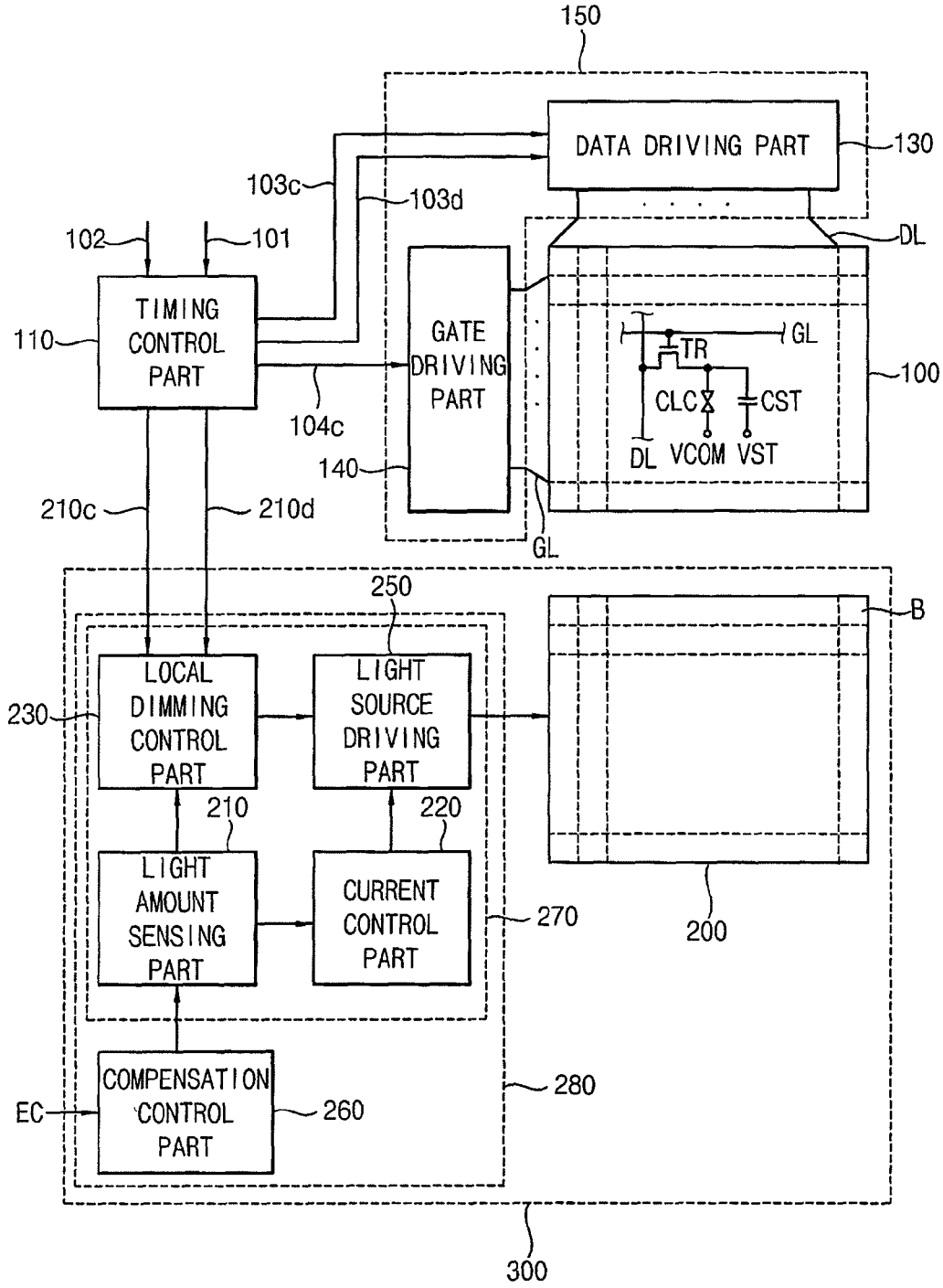
FIG. 1 is a block diagram illustrating a display apparatus according to an exemplary embodiment of the present invention.

FIG. 1 is a block diagram illustrating a display apparatus according to an exemplary embodiment of the present invention. Referring to FIG. 1, the display apparatus includes a display panel 100, a timing control part 110, a panel driving part 150 and a backlight assembly 300.

The display panel 100 includes a plurality of pixels P for displaying an image. For example, the pixels P may be arranged in an M×N matrix, where 'M' and 'N' are natural numbers. Each of pixels P includes a switching element TR connected to a gate line GL and a data line DL, and a liquid crystal capacitor CLC and a storage capacitor CST that are connected to the switching element TR.

The timing control part 110 receives a primary control signal 101 and a primary image signal 102, which may be provided from an external device (not shown). The timing control part 110 generates a data control signal 103*c* and a gate control signal 104*c* using the received control signal 101. The resulting signals 103*c* and 104*c* control a driving timing of the display panel 100. The data control signal 103*c* may include a horizontal start signal. The gate control signal 104*c* may include a clock signal and a vertical start signal.

The panel driving part 150 includes a data driving part 130 and a gate driving part 140. The data driving part 130 drives a data line DL using the data control signal 103*c* and an image signal 103*d* received from the timing control part 110. For example, the data driving part 130 converts the image signal 103*d* into an analog data signal, and outputs the analog data signal to a data line DL. The gate driving part 140 drives a gate line GL using the gate control signal 104*c* received from the timing control part 110. For example, the gate driving part 140 outputs a gate signal, which turns on or turns off a switching element TR electrically connected to a gate line GL.

The backlight assembly 300 provides the display panel 100 with light. The backlight assembly 300 includes a light source module 200 and light source driving apparatus 280 that drives the light source module 200. The light source driving apparatus 280 includes a compensation control part 260 and a feedback compensation part 270.

The light source module 200 may include a printed circuit board (PCB) in which a plurality of light sources is mounted.

The light sources may include a red light source emitting red light, a green light source emitting green light, and a blue light source emitting blue light.

For example, the light source module 200 may include a first light source emitting light of a first wavelength bandwidth, a second light source emitting light of a second wavelength bandwidth and a third light source emitting light of a third wavelength bandwidth. In at least one embodiment of the present invention, the first light source is a red light source, the second light source is a green light source and the third light source is a blue light source.

The light source module 200 includes an I×J matrix of light-emitting blocks B, where 'I' and 'J' are natural numbers. Each of the light-emitting blocks B may be individually driven in accordance with an image displayed on the display panel 100 through a local dimming mode. Each of the light-emitting blocks B may include the red, green and blue light sources. Each of the light sources may include a light-emitting diode (LED).

The feedback compensation part 270 may include a light amount sensing part 210, a current control part 220, a local dimming control part 230 and a light source driving part 250.

The light amount sensing part 210 detects a light amount emitted from the light source module 200, and provides a light amount signal to the current control part 220 and the local dimming control part 230.

The current control part 220 adjusts a current level of the driving signals provided to the light source driving part 250 based on the light amount signal received from the light amount sensing part 210. For example, the current control part 220 may adjust the current level so that the light amount signal corresponds to reference white color coordinates, so that light amounts of the red, green and blue light may be adjusted.

The local dimming control part 230 receives a control signal 210*c* and an image signal 210*d* provided from the timing control part 110. The local dimming control part 230 may divide the image signal 210*d* into a plurality of image blocks D corresponding to the light-emitting blocks B, and control the luminance of each of the light-emitting blocks B corresponding to the gray level of each of the image blocks D.

The local dimming control part 230 adjusts the reference duty ratios of red, green and blue driving signals based on the light amount signal provided from the light amount sensing part 210. For example, the local dimming control part 230 compares a real light amount ratio corresponding to the red, green and blue light amounts with a reference light amount ratio. When the real light amount ratio does not correspond to the reference light amount ratio, the local dimming control part 230 adjusts duty ratios of the red, green and blue driving signals so that the light amount ratio may be substantially equal to the reference light amount ratio.

The light amount sensing part 210 repeatedly detects the light amount emitted from the light source module 200. The local dimming control part 230 adjusts the duty ratios of the red, green and blue driving signals provided to the light source module 200 based on the light amount signal.

The light source driving part 250 generates the red, green and blue driving signals in accordance with a control signal of the current control part 220 and a control signal of the local dimming control part 230. The driving signal may have a current level and a duty ratio that are adjusted in correspondence with the light amount emitted from the light source module 200.

When the feedback compensation part 270 repeatedly operates at least once, the feedback compensation part 270 may adjust colored light to the reference white color coordinates, so that a duty ratio of the driving signal may be controlled. Here, the colored light is light, which is emitted from the light sources to be detected by the light amount sensing part 210.

For example, the feedback compensation part 270 may repeatedly adjust the duty ratios of the red, green and blue driving signals in correspondence with the reference white color coordinates to compensate the duty ratios of the red, green and blue driving signals. Therefore, the light amount of full white light may be maintained uniformly in accordance with the light amount of the light source module 200.

The compensation control part 260 controls the light amount sensing part 210 to adjust duty adjustment times of the driving signal driving the light sources based on a dimming control signal EC, which may be provided from an external device (not shown). The dimming control signal EC may be provided in accordance with a user operation. The compensation control part 260 controls the light amount sensing part 210 according to a feedback frequency (e.g., the number duty adjustments performed by the feedback compensation part 270 per unit time).

For example, the compensation control part 260 adjusts the duty ratios of the driving signal provided to the light sources to reduce the feedback frequency, when the dimming control signal EC having a low dimming level DIL is applied to the compensation control part 260 to display a low luminance image. Thus, the feedback compensation part 270 may repeatedly adjust the duty ratios of the red, green and blue driving signals in correspondence with the feedback frequency.

Figure 2:
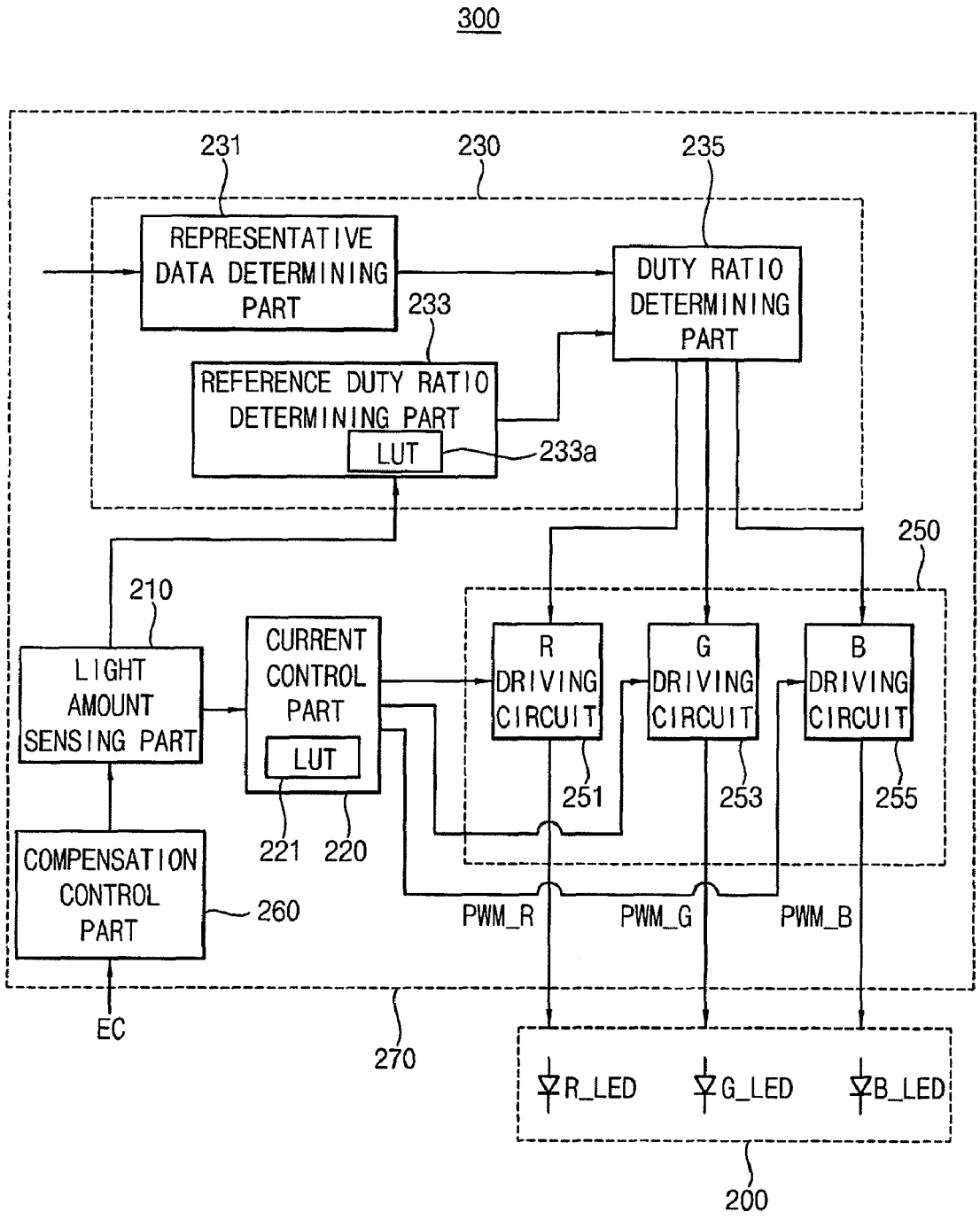
FIG. 2 is a block diagram illustrating the backlight assembly of FIG. 1 according to an exemplary embodiment of the present invention.

FIG. 2 is a block diagram illustrating the backlight assembly of FIG. 1 according to an exemplary embodiment of the present invention. Referring to FIGS. 1 and 2, the backlight assembly 300 includes the light source module 200 and the feedback compensation part 270. The feedback compensation part 270 includes the light amount sensing part 210, the current control part 220, the local dimming control part 230 and the light source driving part 250.

The light amount sensing part 210 detects the light amount emitted from the light source module 200, and provides the light amount signal to the current control part 220 and the local dimming control part 230.

The current control part 220 includes a lookup table (LUT) 221 and adjusts the current levels of the driving signal provided to the light source driving part 250 based on the light amount signal. The LUT 221 stores the current levels of the driving signal corresponding to the light amount signal. Therefore, the current control part 220 may adjust the current levels so that the light amount signal corresponds to the reference white color coordinates, so that the red, green and blue light amounts may be adjusted.

The local dimming control part 230 includes a representative data determining part 231, a reference duty ratio determining part 233 and a duty ratio determining part 235. The representative data determining part 231 receives the control signal 210*c* and the image signal 210*d* from the timing control part 110, and divides the image signal 210*d* into a plurality of image blocks D corresponding to the light-emitting blocks B. The representative data determining part 231 determines red, green and blue representative gray levels by using red, green and blue gray levels of each of the image blocks D.

For example, the representative gray levels may include an average gray level, a maximum gray level, etc. Therefore, the representative data determining part 231 determines the red, green and blue representative gray levels of the image block D corresponding to the light-emitting blocks B.

The reference duty ratio determining part 233 includes an LUT 233*a*, and determines the reference duty ratios of the red, green and blue driving signals in accordance with the light amount of an external environment based on the received light amount signal. For example, the reference duty ratios may be duty ratios of the red, green and blue driving signals for full white light.

The duty ratio determining part 235 determines duty ratios of the red, green and blue driving signals by using the red, green and blue representative gray levels data corresponding to the light-emitting block B based on the reference duty ratios of the red, green and blue driving signals that are determined in accordance with the light amount of the light source module 200. Thus, each of the red, green and blue driving signals may have duty ratios corresponding to the color dimming mode.

The light source driving part 250 includes a red (R) driving circuit 251, a green (G) driving circuit 253 and a blue (B) driving circuit 255. Each of the red, green and blue driving circuits 251, 253 and 255 generates the red, green and blue driving signals respectively by using driving currents that are provided from the current control part 220 and the duty ratios that are provided from the duty ratio determining part 235.

The red driving circuit 251 provides the red light sources R_LED of the light-emitting block B with the red driving signal PWM_R. The green driving circuit 253 provides the green light sources G_LED of the light-emitting block B with the green driving signal PWM_G. The blue driving circuit 255 provides the blue light sources B_LED of the light-emitting block B with the blue driving signal PWM_B.

As a result, the reference duty ratios of the red, green and blue driving signals relative to the full white light are changed corresponding to the light amount of the light source module 200. Therefore, the current level provided to the light source module 200 is changed corresponding to the changed reference duty ratios. The duty ratios are adjusted corresponding to the changed current level to compensate the full white light of the red, green and blue light sources to be constant. Accordingly, a constant color may be visible regardless of the light amount of the light source module 200.

The compensation control part 260 controls the light amount sensing part 210 in response to the dimming control signal EC, which may be provided from an external device. When the dimming control signal EC having the low dimming level DIL is applied to the compensation control part 260 to display a low luminance image, the compensation control part 260 reduces the feedback frequency. Thus, the feedback compensation part 270 may repeatedly adjust the duty ratios of the red, green and blue driving signals in correspondence with the feedback frequency.

Alternatively, when the dimming control signal EC having a high dimming level DIL is applied to the compensation control part 260 to display a high luminance image, the compensation control part 260 maintains a feedback frequency to be identical or substantially identical to a feedback frequency in which the dimming control signal EC is not applied. The feedback compensation part 270 may repeatedly adjust the duty ratios of the red, green and blue driving signals in correspondence with the feedback frequency.

When the light source module 200 is operated in correspondence with a low dimming level DIL, a color distortion rate may be high. However, when the feedback compensation part 270 is operated in a constant feedback frequency to compensate a high color distortion, the duty ratios of the red, green and blue driving signals are compensated in correspondence with reference white color coordinates and a relatively high color oscillation may be generated.

The color distortion may not be visible; however, the color oscillation may be visible. Therefore, the compensation control part 260 can reduce the feedback frequency, so that generation of the color oscillation may be reduced or prevented.

Figure 3:
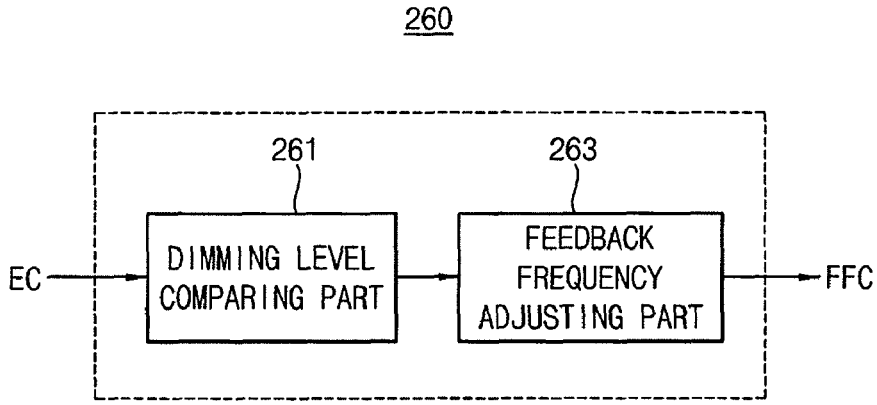
FIG. 3 is a block diagram illustrating the compensation control part of FIG. 2 according to an exemplary embodiment of the present invention.

FIG. 3 is a block diagram illustrating the compensation control part of FIG. 2 according to an exemplary embodiment of the present invention. Referring again to FIGS. 2 and 3, the compensation control part 260 includes a dimming level comparing part 261 and a feedback frequency adjusting part 263. A reference dimming level DLR may be, for example, about 20%.

The dimming level comparing part 261 compares the dimming level DIL of the dimming control signal EC with the reference dimming level DLR. The feedback frequency adjusting part 263 provides the feedback compensation part 270 with a feedback frequency control signal FFC, which controls a feedback frequency (e.g., the number duty adjustments performed by the feedback compensation part 270 per unit time) in accordance with an output of the dimming level comparing part 261.

For example, when the dimming level DIL corresponding to the dimming control signal EC is higher than the reference dimming level DLR, the color distortion corresponding to light emitted from the light source module 200 may be low. Therefore, the feedback compensation part 270 can compensate the duty ratios of the red, green and blue driving signals in correspondence with the feedback frequency that is substantially the same as when the dimming control signal EC is not applied. The feedback frequency may range from about 95 Hz through about 105 Hz. For example, the feedback compensation part 270 may be operated about 95 times through 105 times per second.

When the dimming level DIL corresponding to the dimming control signal EC is higher than the reference dimming level DLR, color coordinates of the light emitted from the light source module 200 may be close to the reference white color coordinates. Therefore, generation of the color oscillation may be low even though the duty ratios of the red, green and blue driving signal are repeatedly compensated by the feedback compensation part 270. Thus, the color oscillation may not be apparent.

When the dimming level DIL corresponding to the dimming control signal EC is lower than the reference dimming level DLR, the color distortion corresponding light emitted from the light source module 200 may be high. Therefore, the feedback compensation part 270 can compensate the duty ratios of the red, green and blue driving signals in correspondence with a reduced feedback frequency when the dimming control signal EC is not applied.

When the dimming level DIL corresponding to the dimming control signal EC is lower than the reference dimming level DLR, the color coordinates of the light emitted from the light source module 200 may be substantially far from the reference white color coordinates. Moreover, even though the duty ratios of the red, green and blue driving signals are repeatedly compensated to approach the reference white color coordinates, the color coordinates corresponding to the compensated duty ratios may not be close to the reference white color coordinates. Therefore, the amplitude of the color oscillation may be high, so that the color oscillation caused by colors that are changeable with time may be viewed.

However, according to at least one embodiment of the present invention, the feedback compensation part 270 compensates the duty ratios of the red, green and blue driving signal in accordance with a relatively low feedback frequency to reduce the amplitude of the color oscillation. Therefore, defects of which the color oscillation is higher may be prevented. Here, the relatively low feedback frequency may range from about 0.5 Hz through about 5 Hz.

Figure 4:
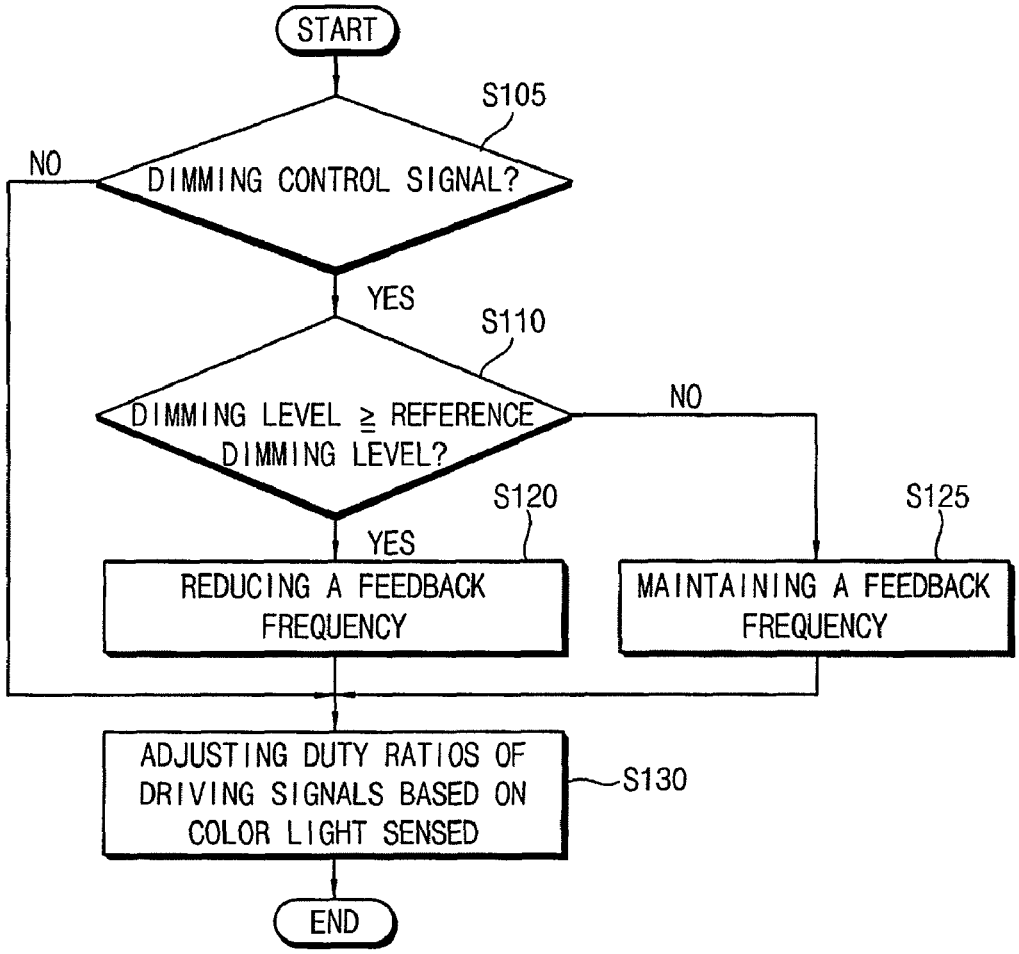
FIG. 4 is a flowchart illustrating a method of driving the backlight assembly of FIG. 2 according to an exemplary embodiment of the present invention.

FIG. 4 is a flowchart illustrating a method of driving the backlight assembly of FIG. 2 according to an exemplary embodiment of the present invention. Referring to FIGS. 2 and 4, it is determined whether or not the dimming control signal EC is applied (step S105).

In step S105, when the dimming control signal EC is applied, the dimming level comparing part 261 determines whether or not the dimming level DIL of the dimming control signal EC is lower than the reference dimming level DLR stored in the dimming level comparing part 261 (step S110).

In step S110, when it is determined that the dimming level DIL is equal to or higher than the reference dimming level DLR, the compensation control part 260 reduces the feedback frequency (e.g., the number of duty adjustments of the driving signal per unit time) (step S120). Then, the feedback compensation part 270 adjusts the color light emitted from the light sources of the light source module 200 in correspondence with the reference white color coordinates to adjust the duty ratios of the driving signal in accordance with the reduced feedback frequency (step S130).

In step S110, when it is determined that the dimming level DIL is lower than the reference dimming level DLR, the compensation control part 260 maintains the feedback frequency (e.g., the number of duty adjustments of the driving signal per unit time) (step S125).

When it is determined that the dimming control signal EC is not applied in step S105, or after step S120 or step S125, the feedback compensation part 270 adjusts the color light emitted from the light sources of the light source module 200 to the reference white color coordinates in accordance with the maintained feedback frequency, so that the duty ratios of the driving signal is adjusted (step S130). For example, when the dimming control signal EC is not applied, the feedback compensation part 270 is operated with substantially the same feedback frequency (e.g., the number of operations performed by the feedback compensation part 270 per unit time).

As described above, the compensation control part 260 controls the operation of the feedback compensation part 270, so that high color oscillation, which may be generated when the dimming level of the dimming control signal EC is not sufficiently high, may be reduced or prevented.

Figure 5:
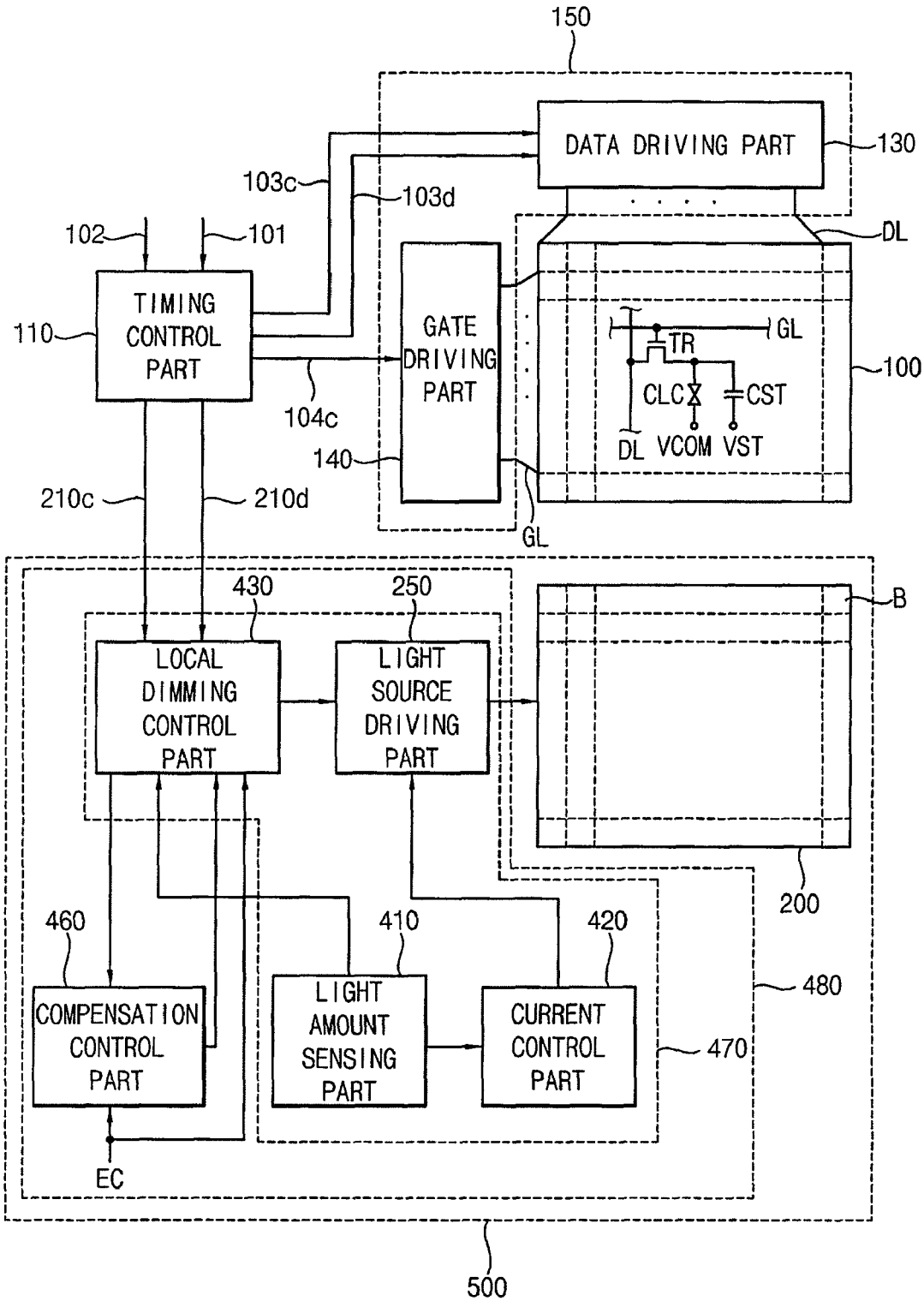
FIG. 5 is a block diagram illustrating a display apparatus according to an exemplary embodiment of the present invention.

FIG. 5 is a block diagram illustrating a display apparatus according to an exemplary embodiment of the present invention. Referring to FIG. 5, the display apparatus includes the display panel 100, the timing control part 110, the panel driving part 150 and a backlight assembly 500. The display apparatus of FIG. 5 is substantially the same as the display apparatus of FIG. 1, except for the backlight assembly 500. Thus, the same reference numbers are used for the same elements, and repetitive descriptions are omitted.

The backlight assembly 500 provides the display panel 100 with light. The backlight assembly 500 includes the light source module 200 and light source driving apparatus 480 driving the light source module 200. The driving apparatus 480 includes a compensation control part 460 and a feedback compensation part 470.

The feedback compensation part 470 includes a light amount sensing part 410, a current control part 420, a local dimming control part 430 and a light source driving part 250. The light amount sensing part 410 detects the light amount of the light source module 200, and provides the current control part 420 and the local dimming control part 430 with a light amount signal.

The current control part 420 adjusts a current level of the driving signals provided to the light source driving part 250 based on the light amount signal received from the light amount sensing part 410. For example, the current control part 420 may adjust the current level so that the light amount signal corresponds to reference white color coordinates, so that light amounts of the red, green and blue light may be adjusted.

The local dimming control part 430 may divide the image signal **210*d*** into a plurality of image blocks D corresponding to the light-emitting blocks B, and control the luminance of each of the light-emitting blocks B corresponding to the gray level of each of the image blocks D.

The local dimming control part 430 adjusts reference duty ratios of red, green and blue driving signals based on the light amount signal provided from the light amount sensing part 410. For example, the local dimming control part 430 compares a real light amount ratio corresponding to the red, green and blue light amounts with a reference light amount ratio. When the real light amount ratio does not correspond to the reference light amount ratio, the local dimming control part 430 adjusts duty ratios of the red, green and blue driving signals so that the light amount ratio may be substantially equal to the reference light amount ratio.

The light amount sensing part 410 repeatedly detects the light amount of the light source module 200. The local dimming control part 430 adjusts the duty ratios of the red, green and blue driving signals provided to the light source module 200 based on the light amount signal.

The light source driving part 250 generates the red, green and blue driving signals in accordance with a control signal of the current control part 220 and a control signal of the local dimming control part 430. The driving signal may have a current level and a duty ratio that are adjusted in correspondence with the light amount emitted from the light source module 200.

For example, the feedback compensation part 470 may repeatedly adjust the duty ratios of the red, green and blue driving signals in correspondence with the reference white color coordinates to compensate the duty ratios of the red, green and blue driving signals. Therefore, the light amount of full white light may be uniformly maintained in accordance with the light amount of the light source module 200.

The compensation control part 460 provides the feedback compensation part 470 with a feedback stop signal that controls the feedback compensation part 470. The dimming control signal EC may be provided in accordance with a user operation. The compensation control part 460 controls the number of operations of the feedback compensation part 470 based on the feedback stop signal.

For example, when the dimming control signal EC is applied, the feedback compensation part 470 stops repeatedly adjusting the duty ratios of the red, green and blue driving signals. The feedback compensation part 470 may adjust the duty ratios of the red, green and blue driving signals one time.

When the duty ratios of the red, green and blue driving signals is adjusted, the light amount sensing part 410 repeatedly detects the light amount of the light source module 200. The local dimming control part 430 does not adjust the duty ratios of the red, green and blue driving signals provided to the light source module 200 based on the light amount. Instead of adjusting based on the light amount, the local dimming control part 430 adjusts the duty ratios of the red, green and blue driving signals that are adjusted just before the dimming control signal EC is applied, in correspondence with the dimming level.

For example, the feedback compensation part 470 repeatedly stops operations of sensing the light amount and repeatedly adjusts the light amount so that the light amount signal corresponds to the reference color coordinates of white light. The feedback compensation part 470 adjusts the duty ratios of the red, green and blue driving signals that are adjusted just before the dimming control signal EC is applied, in correspondence with the dimming level. Therefore, response time of the display apparatus may be improved.

Further, the feedback compensation part 470 provides the reference duty ratios to the compensation control part 460 to enable the compensation control part 460 to determine whether the duty ratios of the red, green and blue driving signals are in a stabilization range. Therefore, the feedback compensation part 470 may adjust the duty ratios of the red, green and blue driving signals in the stabilization range.

Figure 6:
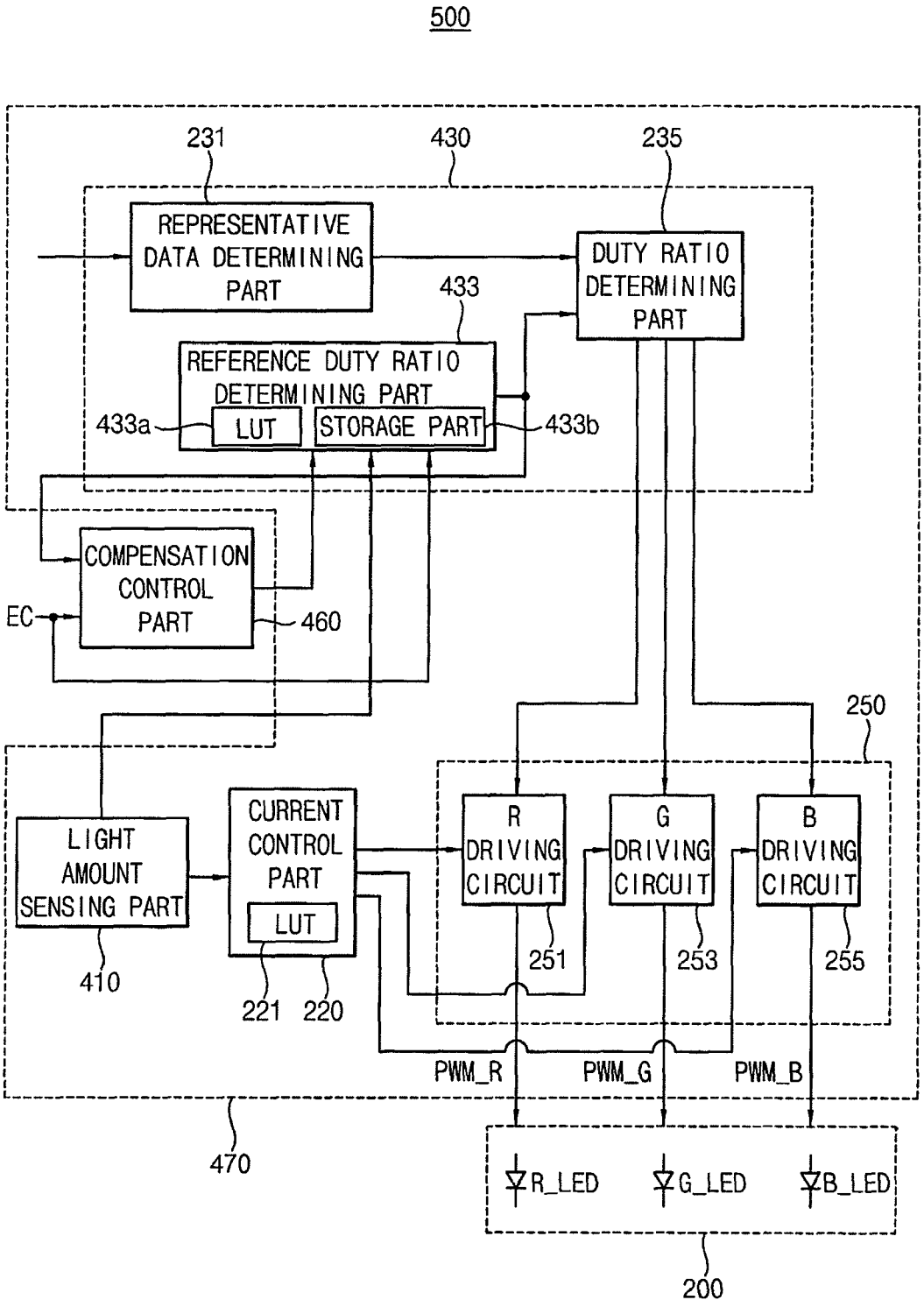
FIG. 6 is a block diagram illustrating the backlight assembly of FIG. 5 according to an exemplary embodiment of the present invention.

FIG. 6 is a block diagram illustrating the backlight assembly of FIG. 5 according to an exemplary embodiment of the present invention. Referring to FIGS. 5 and 6, the backlight assembly 500 includes the light source module 200 and the feedback compensation part 470.

The feedback compensation part 470 includes a light amount sensing part 410, the current control part 220, a local dimming control part 430 and the light source driving part 250. The light amount sensing part 410 detects the light amount of the light source module 200, and provides the current control part 220 and the local dimming control part 430 with a light amount signal.

The current control part 220 includes an LUT 221 and adjusts the current levels of the driving signal provided to the light source driving part 250 based on the light amount signal. The LUT 221 stores the current levels of the driving signal corresponding to the light amount signal. Therefore, the current control part 220 may adjust the current levels so that the light amount signal corresponds to the reference white color coordinates, so that the red, green and blue light amounts may be adjusted.

The local dimming control part 430 includes the representative data determining part 231, a reference duty ratio determining part 433 and the duty ratio determining part 235.

The representative data determining part 231 receives the control signal 210*c* and the image signal 210*d* from the timing control part 110, and divides the image signal 210*d* into a plurality of image blocks D corresponding to the light-emitting blocks B. The representative data determining part 231 determines red, green and blue representative gray levels by using red, green and blue gray levels of each of the image blocks D. For example, the representative gray level may be an average gray level, a maximum gray level, etc. Therefore, the representative data determining part 231 determines the red, green and blue representative gray levels of the image block D corresponding to the light-emitting blocks B.

The reference duty ratio determining part 433 includes an LUT 433*a* and a storage part 433*b*, and determines the reference duty ratios of the red, green and blue driving signals in accordance with the light amount of an external environment based on the received light amount signal. For example, the reference duty ratios may be duty ratios of the red, green and blue driving signals for full white light.

The reference duty ratio determining part 433 determines the reference duty ratios of the red, green and blue driving signals based on the received light amount signal by using the LUT 433*a*. When the reference duty ratio determining part 433 receives the dimming control signal EC and the compensation control part 460 receives the feedback stop signal, the storage part 433*b* of the reference duty ratio determining part 433 stores the reference duty ratios of the red, green and blue driving signals just before the dimming control signal EC is applied.

The reference duty ratio determining part 433 adjusts the reference duty ratios of the red, green and blue driving signals in correspondence with the dimming level of the dimming control signal EC, and provides the duty ratio determining part 235 with the adjusted reference duty ratios.

The duty ratio determining part 235 determines duty ratios of the red, green and blue driving signals by using the red, green and blue representative gray levels data corresponding to the light-emitting block B based on the reference duty ratios of the red, green and blue driving signals that are determined in accordance with the light amount of the light source module 200. Thus, each of the red, green and blue driving signals may have duty ratios corresponding to the color dimming mode.

The light source driving part 250 includes a red (R) driving circuit 251, a green (G) driving circuit 253 and a blue (B) driving circuit 255. Each of the red, green and blue driving circuits 251, 253 and 255 generates the red, green and blue driving signals respectively by using driving currents that are provided from the current control part 220 and the duty ratios that are provided from the duty ratio determining part 235.

The red driving circuit 251 provides the red light sources R_LED of the light-emitting block B with the red driving signal PWM_R. The green driving circuit 253 provides the green light sources G_LED of the light-emitting block B with the green driving signal PWM_G. The blue driving circuit 255 provides the blue light sources B_LED of the light-emitting block B with the blue driving signal PWM_B.

The compensation control part 460 controls the feedback compensation part 470 in response to the dimming control signal EC, which may be provided from an external device.

The response time of the display apparatus may be slow when the light source module 200 operates in correspondence with the dimming level controlling the luminance of the light source module 200. Therefore, the compensation control part 460 may control the number of operations of the feedback compensation part 470, and adjust the temporally stored reference duty ratios of the red, green and blue driving signals in correspondence with the dimming level.

Accordingly, the feedback compensation part 470 may be prevented from unnecessarily performing repeated adjustments of the reference duty ratios of the red, green and blue driving signals to compensate the light amount even though the light amount of the light source module 200 is reduced. Therefore, the response time of the display apparatus may be improved.

Figure 7:
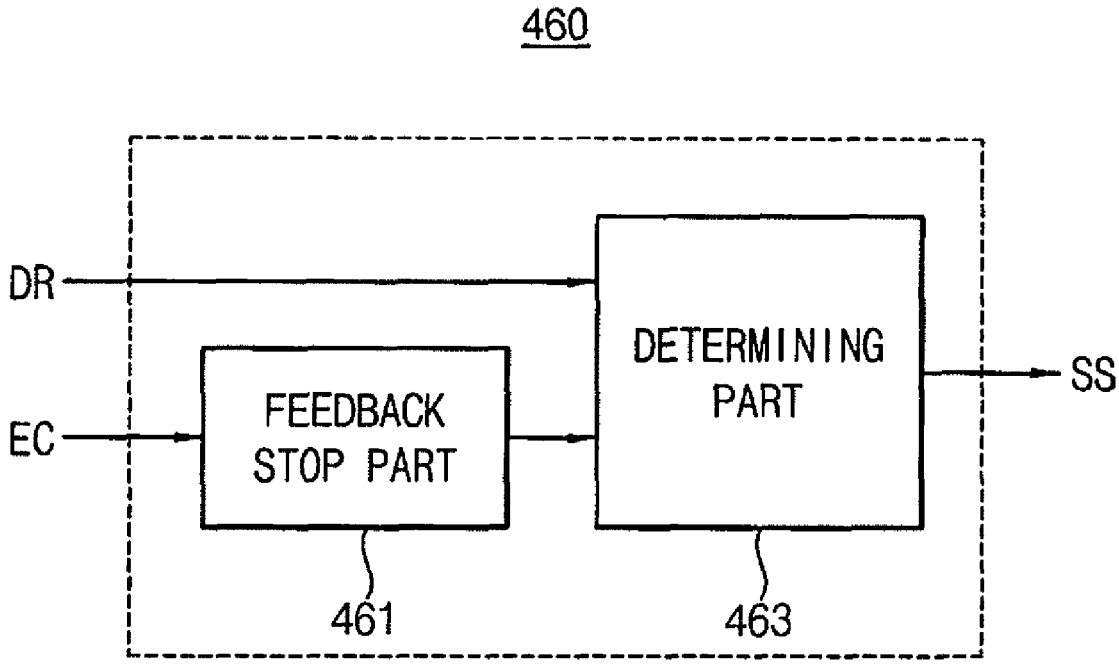
FIG. 7 is a block diagram illustrating the compensation control part of FIG. 6 according to an exemplary embodiment of the present invention.

FIG. 7 is a block diagram illustrating the compensation control part of FIG. 6 according to an exemplary embodiment of the present invention. Referring to FIGS. 6 and 7, the compensation control part 460 includes a feedback stop part 461 and a determining part 463.

The feedback stop part 461 generates the feedback stop signal stopping the general operation of the feedback compensation part 470. The determining part 463 receives the reference duty ratios DR of the red, green and blue driving signals determined just before the dimming control signal EC is applied from the reference duty ratio determining part 433 to determine the reference duty ratios DR of the red, green and blue driving signals are in the stabilization range.

The determining part 463 provides the storage part 433*b* with a store signal SS to enable the storage part 433*b* to store the reference duty ratios DR of the red, green and blue driving signals when reference duty ratios DR of the red, green and blue driving signals are within the stabilization range.

The reference duty ratio determining part 433 determines the duty ratios of the red, green and blue driving signals by using the red, green and blue representative gray levels of the light-emitting block B based on the reference duty ratios determined according to the light amount of the light source module 200.

Figure 8:
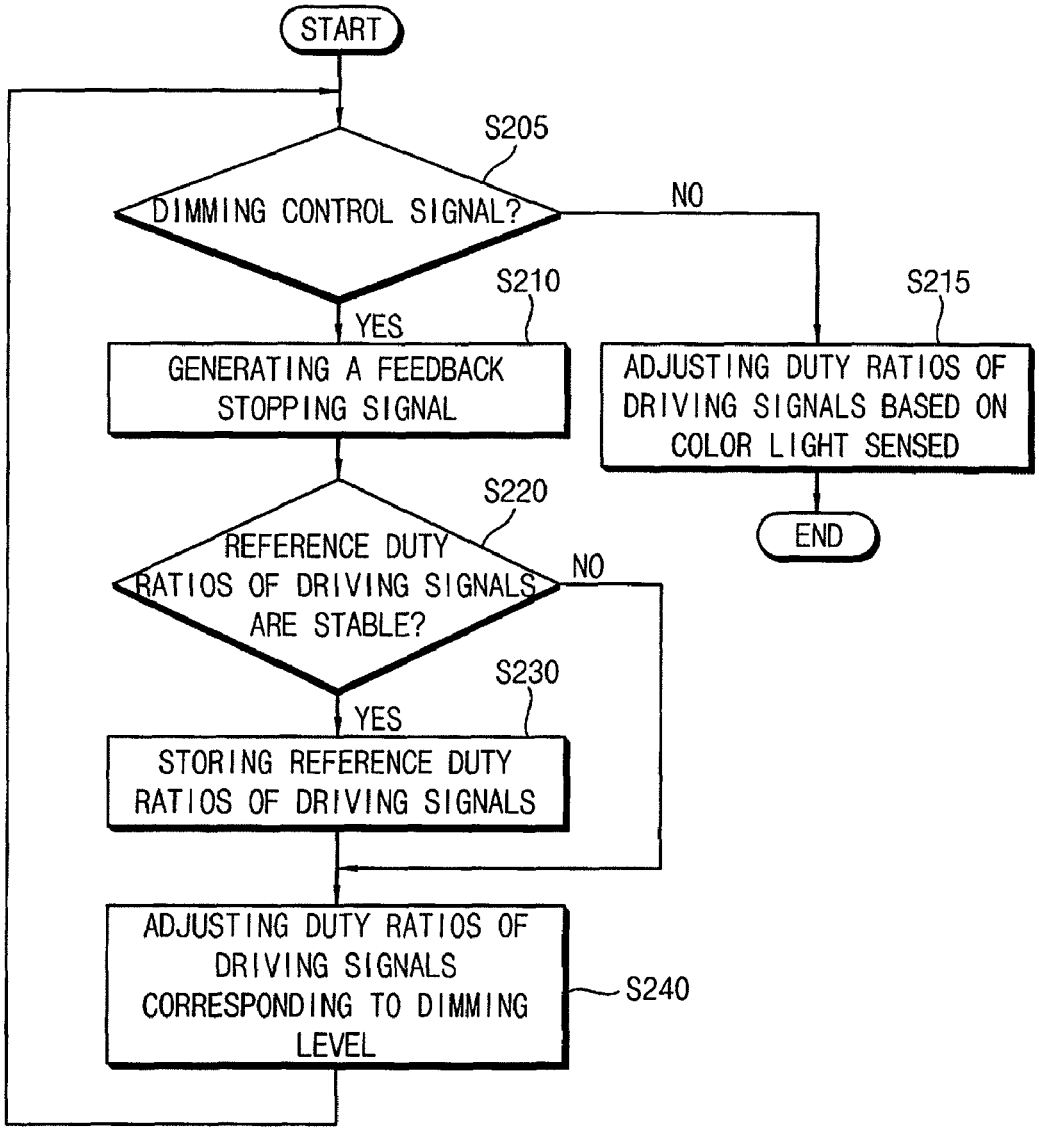
FIG. 8 is a flowchart illustrating a method of driving the backlight assembly of FIG. 6 according to an exemplary embodiment of the present invention.

FIG. 8 is a flowchart illustrating a method of driving the backlight assembly of FIG. 6 according to an exemplary embodiment of the present invention. Referring to FIGS. 6, 7 and 8, it is determined whether or not the dimming control signal EC is applied (step S205).

In step S205, when the dimming control signal EC is applied, the feedback stop part 461 of the compensation control part 460 provides the determining part 463 with the feedback stop signal (step S210).

Then, the determining part 463 determines whether or not the reference duty ratios DR of the red, green and blue driving signals that are determined just before the dimming control signal EC is applied are within a stabile range (step S220).

In step S220, when the reference duty ratio is determined to be in the stabile range, the reference duty ratio determining part 433 stores the reference duty ratios of the red, green and blue driving signals that the determining part 463 determines just before the dimming control signal EC is applied in the storage part 433*b*, instead of determining the reference duty ratios of the red, green and blue driving signals in accordance with the light amount.

Then, the reference duty ratio determining part 433 adjusts the reference duty ratios of the red, green and blue driving signals, so that the reference duty ratios of the red, green and blue driving signals correspond to the dimming level of the dimming control signal EC (step S240).

In step S220, when the reference duty ratio is determined to be out of the stabile range, the reference duty ratio determining part 433 does not store the reference duty ratios of the red, green and blue driving signals, which the determining part 463 determines just before the dimming control signal EC is applied to the storage part 433*b*. Instead of storing, the reference duty ratios of the red, green and blue driving signals are determined in correspondence with the dimming level of the dimming control signal EC (step S240), and the following step is step S205.

In step S205, when it is determined that the dimming control signal is not to be applied, the compensation control part 460 does not generate any signal, and the feedback compensation part 470 adjusts the reference duty ratios of the driving signal to compensate the color light emitted from the light sources and detected in correspondence with the reference color coordinates of white light (step S215).

For example, when a first dimming control signal EC is received (e.g., from an external device), the feedback stop part 461 provides the determining part 463 with the feedback stop signal.

Then, the determining part 463 determines whether first reference duty ratios determined just before the first dimming control signal EC is applied are within the stabile range or not.

The first reference duty ratios are determined just before the first dimming control signal EC is in the stabile range because the color light emitted from the light sources included in the light source module 200 and detected may be sufficiently compensated in correspondence with the reference color coordinates of white light, before the first dimming control signal EC is applied.

Therefore, the storage part 433*b* of the reference duty ratio determining part 433 stores the determined the first reference duty ratios of the red, green and blue driving signals, and the determining part 463 adjusts the first reference duty ratios of the red, green and blue driving signals in correspondence with the dimming level of the dimming control signal EC.

Then, the compensation control part 460 does not generate any control signal before a second dimming control signal EC. The light source module driving part 470 compensates the color light emitted from the light sources included in the light source module 200 and detected in correspondence with the reference color coordinates of white light.

Then, when the second dimming control signal EC is applied, the feedback stop part 461 provides the determining part 463 with the feedback stop signal. Then, the determining part 463 determines whether second reference duty ratios determined just before the second dimming control signal EC is applied are within the stabile range or not.

According to the determination, when the second reference duty ratios of the red, green and blue driving signals are in the stabile range, the storage part 433*b* of the reference duty ratio determining part 433 stores the second reference duty ratios of the red, green and blue driving signals.

When the second dimming control signal EC is applied just after the compensation corresponding to the first dimming control signal EC is applied, the second reference duty ratios of the red, green and blue driving signals may not be sufficiently compensated at the light source module driving part 470. Therefore, the second reference duty ratios of the red, green and blue driving signals determined just before the second dimming control signal EC is applied may not be in the stabile range.

Therefore, when the second reference duty ratios of the red, green and blue driving signals are not in the stabile range, the first reference duty ratios of the red, green and blue driving signals stored in the storage part 433*b* are adjusted corresponding to the dimming level of the second dimming control signal EC, instead of storing the second reference duty ratios of the red, green and blue driving signals in the storage part 433*b* of the reference duty ratio determining part 433.

According to at least one exemplary embodiment of the present invention, when the dimming control signals are continuously applied and the light amount of the light source module 200 is rapidly reduced, the compensations based on the dimming control signals EC may be performed as many times as the number of the dimming control signals EC. Therefore, the light source module driving part 470 may be prevented from repeatedly compensating the light amount based on the light amount detected at the light source module 200. Thus, the response time of the display apparatus may be improved.

Further, more accurate compensation may be possible because the reference duty ratios may be compensated only when the reference duty ratios are determined to be in the stabilization range.

According to at least one exemplary embodiment of the present invention, color oscillation may be prevented by controlling a feedback frequency (e.g., the number of duty adjustments performed by a feedback compensation part per unit time) according to a dimming control signal, which may be provided from an external device.

Further, the response time of a display apparatus may be improved by controlling the feedback compensation part to operate once according to the dimming control signal, which may be provided from the external device.

Although exemplary embodiments of the present invention have been described, those skilled in the art will readily appreciate that various modifications can be made without departing from the spirit and scope of the present disclosure. Accordingly, all such modifications are intended to be included within the scope of the present disclosure.

What is claimed is:

1. A method of driving a light source, the method comprising:

adjusting a number of duty adjustments of driving signals driving light sources based on a dimming control signal; and adjusting each duty ratio of each of the driving signals provided to each of the light sources in accordance with the adjusted number of the duty adjustments, wherein adjusting the number of duty adjustments of the driving signals comprises:

comparing a dimming level of the dimming control signal with a reference dimming level; and adjusting a feedback frequency based on a result of the comparing, wherein the feedback frequency is the number of the duty ratios of the driving signals that is repeatedly adjusted per unit time, and wherein the feedback frequency is reduced when the dimming level of the dimming control signal is lower than the reference dimming level.

2. The method of claim 1, wherein the light sources comprise a red light source, a green light source and a blue light source.

3. The method of claim 1, wherein the feedback frequency is maintained when the dimming level of the dimming control signal is greater than or equal to the reference dimming level.

4. The method of claim 1, further comprising adjusting each duty ratio of the driving signals based on color light sensed by a light sensor when the dimming control signal is de-asserted.

5. The method of claim 1, wherein adjusting the number of duty adjustments of the driving signals is performed based on whether reference duty ratios of the driving signals are in a stable range, wherein the reference duty ratios are provided to the light sources based on the dimming control signal, and adjusting each of the duty ratios of each of the driving signals is performed by storing the reference duty ratios of the driving signal for adjusting the duty ratios of the driving signal provided to the light source based on whether the reference duty ratios of the driving signals are in the stable range.

6. The method of claim 5, when the reference duty ratios are determined as to be in the stable range in adjusting the number of duty adjustments of the driving signals, the duty ratios of the driving signal are adjusted based on the stored reference duty ratios of the driving signal and the dimming level of the dimming control signal in adjusting each of the duty ratios of each of the driving signals.

7. A light source driving apparatus comprising:

a compensation control part configured to adjust a number of duty adjustments of driving signals driving light sources based on a dimming control signal; and a feedback compensation part configured to adjust each duty ratio of each of the driving signals provided to each of the light sources in accordance with the adjusted number of the duty adjustments adjusted by the compensation control part, wherein the compensation control part comprises:

a dimming level comparing part comparing a dimming level of the dimming control signal with a reference dimming level; and a feedback frequency adjusting part configured to provide the feedback compensation part with a signal which controls a feedback frequency based on a result of the comparing, wherein the feedback frequency is the number of the duty adjustments of the feedback compensation part per unit time, and wherein the feedback frequency adjusting part is configured to reduce the feedback frequency when the dimming level of the dimming control signal is substantially lower than the reference dimming level.

8. The apparatus of claim 7, wherein the feedback compensation part corresponds to a plurality of color light emitted from the light sources and reference white color coordinates to adjust the duty ratios of the driving signal, when the adjusted number of the duty adjustments is at least one, and the feedback compensation part is repeatedly operated by the adjusted number of the duty adjustments.

9. The apparatus of claim 8, wherein the color light comprise red light, green light and blue light.

10. The apparatus of claim 7, wherein the feedback frequency adjusting part maintains the feedback frequency when the dimming level of the dimming control signal is equal to or higher than the reference dimming level.

11. The apparatus of claim 7, wherein the feedback compensation part adjusts the duty ratios of the driving signal based on reference duty ratios of the driving signal and a dimming level of the dimming control signal, when the number of the duty adjustments is at least one.

12. The apparatus of claim 11, wherein the compensation control part comprises a determining part which determines whether or not the reference duty ratios of the driving signal are in a stable range based on the dimming control signal, and the feedback compensation part comprises a storage part which stores the reference duty ratios of the driving signal based on whether the determining part determined the ratios to be in the stable range.

13. A display apparatus comprising:

a display panel configured to display an image;

a light source module comprising a red light source, a green light source and a blue light source to provide the display panel with light;

a compensation control part configured to adjust a number of duty adjustments of the driving signals driving each light source based on a dimming control signal; and a feedback compensation part configured to adjust duty ratios of the driving signals provided to each of the light sources in accordance with the number of the duty adjustments adjusted by the compensation control part, wherein the compensation control part comprises:

a dimming level comparing part comparing a dimming level of the dimming control signal with a reference dimming level; and a feedback frequency adjusting part configured to provide the feedback compensation part with a signal which controls a feedback frequency based on a result of the comparing, wherein the feedback frequency is the number of the duty adjustments of the feedback compensation part per unit time, and wherein the feedback frequency adjusting part is configured to reduce the feedback frequency when the dimming level of the dimming control signal is substantially lower than the reference dimming level.

14. The apparatus of claim 13, wherein the feedback compensation part operates about 95 times through about 105 times per second, when the dimming control signal is not applied thereto.

15. The apparatus of claim 14, wherein the feedback compensation part operates one time and adjusts the duty ratios of the driving signal based on reference duty ratios of the driving signal and a dimming level of the dimming control signal, when the dimming control signal is applied thereto.

* * * * *